US005906014A

United States Patent [19]

Zhuang

[11] Patent Number: 5,906,014

[45] Date of Patent: May 25, 1999

[54] BED FRAME ASSEMBLY

[76] Inventor: Yu-Lin Zhuang, 58, Ma Yuan West St., Taichung, Taiwan

[21] Appl. No.: 09/094,223

[22] Filed: Jun. 9, 1998

[51] Int. Cl.[6] ..... A47D 13/06; A47D 7/00; F16C 11/10

[52] U.S. Cl. ..... 5/99.1; 5/98.1; 403/102

[58] Field of Search ..... 5/98.1, 99.1; 16/321, 16/324, 326, 327; 403/100, 102; 248/150, 149, 153, 166

[56] References Cited

U.S. PATENT DOCUMENTS

| | | | |
|---|---|---|---|
| 3,789,439 | 2/1974 | Berg et al. | 5/99.1 |
| 4,044,411 | 8/1977 | Peterson | 5/99.1 |
| 5,293,656 | 3/1994 | Chan | 5/98.1 X |
| 5,353,451 | 10/1994 | Hsiung | 5/98.1 X |
| 5,474,404 | 12/1995 | Chien | 5/98.1 X |
| 5,539,957 | 7/1996 | Schmidt | 403/102 X |
| 5,730,542 | 3/1998 | Cheng | 5/99.1 X |
| 5,781,944 | 7/1998 | Huang | 5/99.1 |

*Primary Examiner*—Michael F. Trettel
*Assistant Examiner*—Robert G. Santos

[57] ABSTRACT

A bed frame assembly has a lower frame, an upper frame, and four longitudinal rods disposed between the lower frame and the upper frame. The lower frame has four lower corner seats, four elongated bars, four short bars, two link devices, two joints, and a tube device. The tube device has two telescopic tubes and a knuckle. Each telescopic tube has an inner pipe and an outer pipe. Each link device is connected to the inner pipe and two short bars. Each joint is connected to a support leg and two elongated bars. The knuckle is connected to a support post and two outer pipes. The upper frame has four upper corner seats, four couplers, four elongated rods, and four short rods.

3 Claims, 7 Drawing Sheets

BED FRAME ASSEMBLY

BACKGROUND OF THE INVENTION

The present invention relates to a bed frame assembly. More particularly, the present invention relates to a bed frame assembly which is collapsible.

A conventional bed frame often occupies a large room. The conventional bed frame should be detached in order to be folded.

SUMMARY OF THE INVENTION

An object of the present invention is to provide a bed frame assembly which can be folded easily.

Accordingly, a bed frame assembly comprises a lower frame, an upper frame, and four longitudinal rods disposed between the lower frame and the upper frame. The lower frame 1 has four lower corner seats, four elongated bars, four short bars, two link devices, two joints, and a tube device. The tube device has two telescopic tubes, and a knuckle connected to the telescopic tubes. Each of the telescopic tubes has an inner pipe, and an outer pipe receiving the inner pipe. Each of the lower corner seats is connected to the respective longitudinal rod, the respective elongated bar and the respective short bar. Each of the link devices is connected to the respective inner pipe and two short bars. Each of the joints is connected to a support leg and two elongated bars. The knuckle is connected to a support post and two outer pipes. The upper frame has four upper corner seats, four couplers, four elongated rods, and four short rods. Each of the upper corner seats is connected to the respective longitudinal rod, the respective elongated rod and the respective short rod. Each of the couplers is connected to two elongated rods or two short rods.

DETAILED DESCRIPTION OF THE INVENTION

Figure 1:
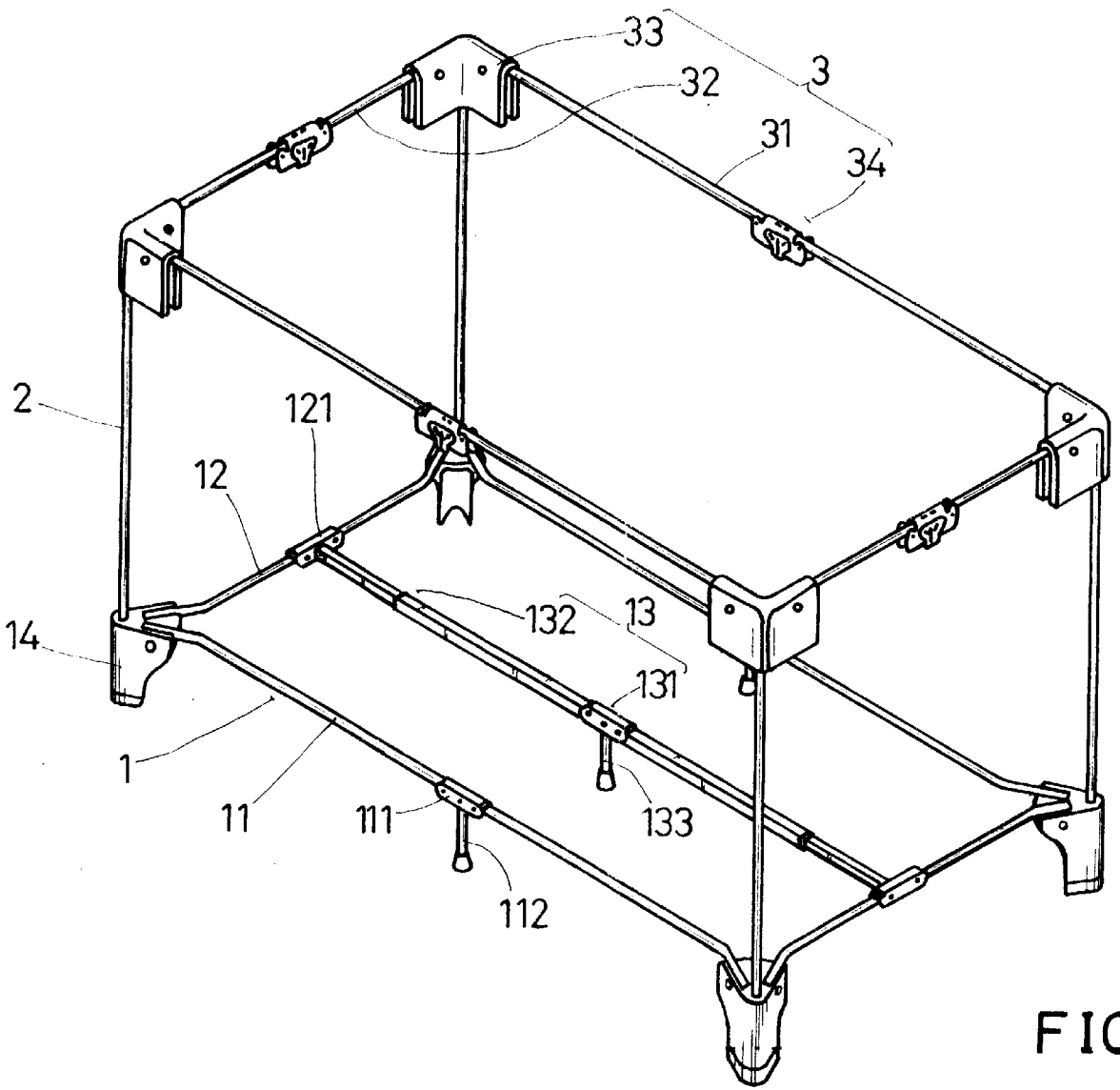
FIG. 1 is a perspective view of a bed frame assembly of a preferred embodiment in accordance with the present invention.
Figure 2:
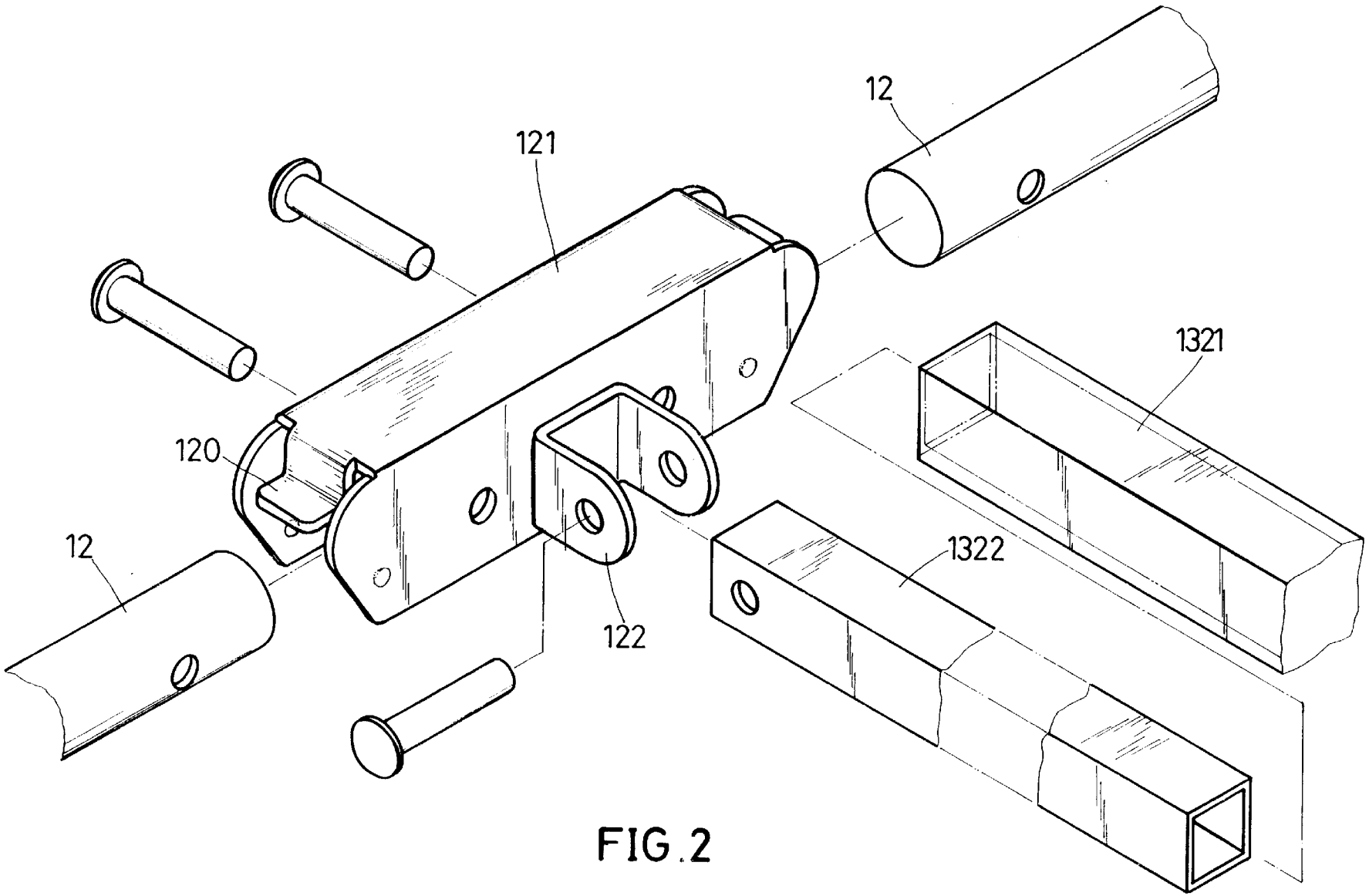
FIG. 2 is a perspective exploded view of a link device of a preferred embodiment in accordance with the present invention.
Figure 3:
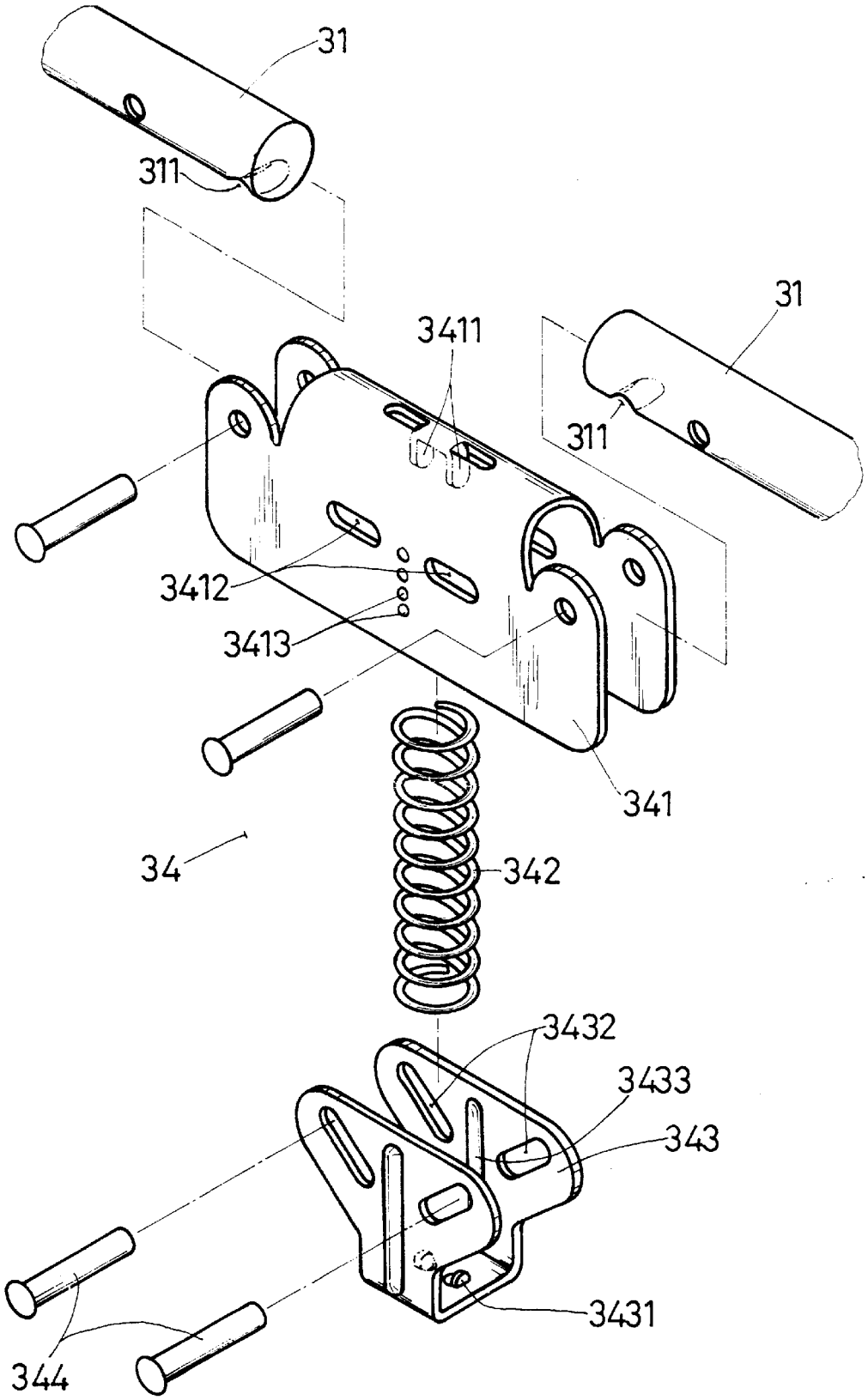
FIG. 3 is a perspective exploded view of a coupler device of a preferred embodiment in accordance with the present invention.
Figure 4:
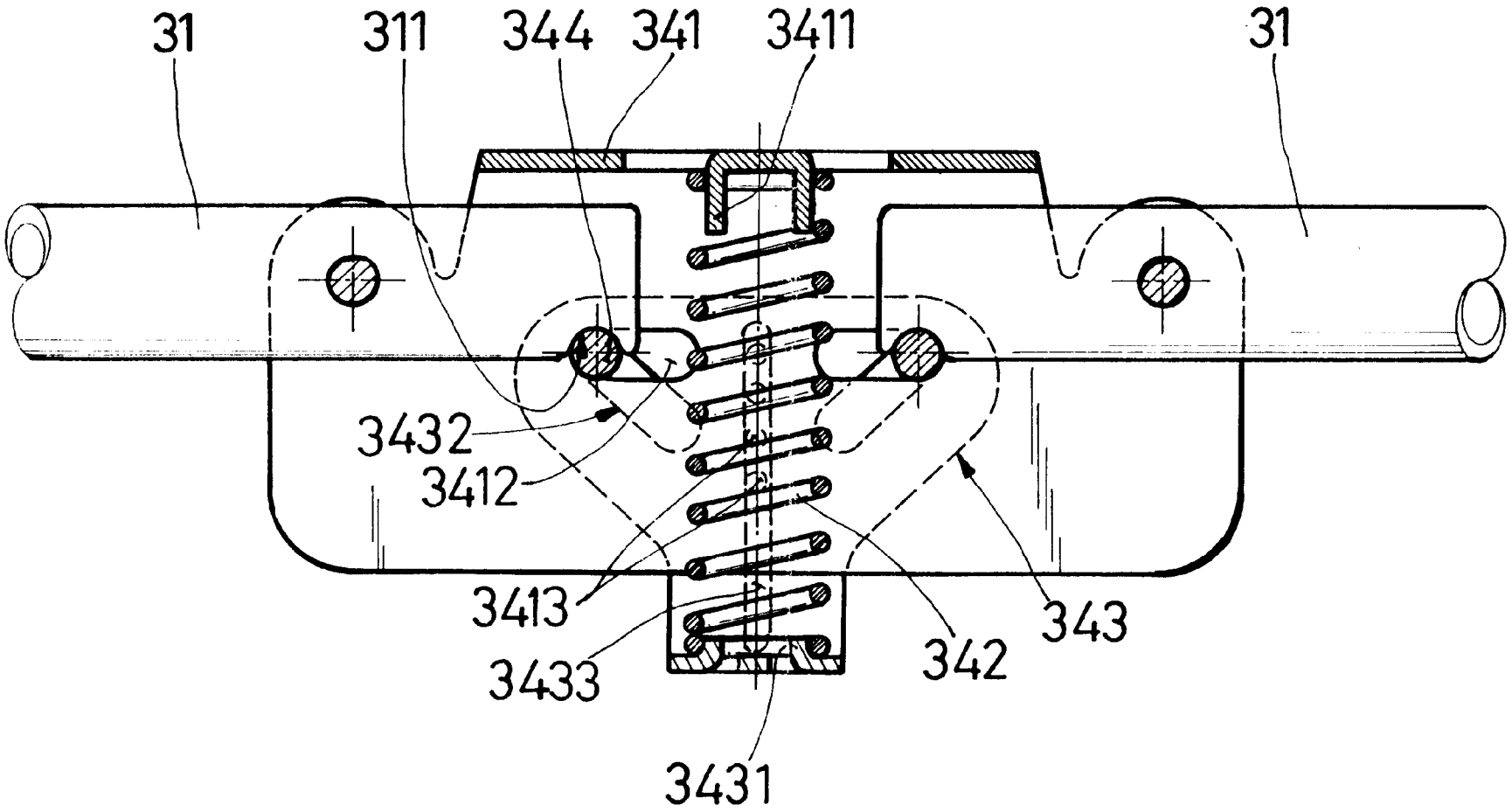
FIG. 4 is a sectional assembly view of a coupler of a preferred embodiment in accordance with the present invention.

Referring to FIGS. 1 to 4, a bed frame assembly comprises a lower frame 1, an upper frame 3, and four longitudinal rods 2 disposed between the lower frame 1 and the upper frame 3. The lower frame 1 has four lower corner seats 14, four elongated bars 11, four short bars 12, two link devices 121, two joints 111, and a tube device 13. The tube device 132 has two telescopic tubes 132, and a knuckle 131 connected to the telescopic tubes 132. Each of the telescopic tubes 132 has an inner pipe 1322, and an outer pipe 1321 receiving the inner pipe 1322. Each of the lower corner seats 14 is connected to the respective longitudinal rod 2, the respective elongated bar 11, and the respective short bar 12. Each of the link devices 121 is connected to the respective inner pipe 1322 and two short bars 12. Each of the joints 111 is connected to a support leg 112 and two elongated bars 11. The knuckle 131 is connected to a support post 133 and two outer pipes 1321. The upper frame 3 has four upper corner seats 33, four couplers 34, four elongated rods 31, and four short rods 32. Each of the upper corner seats 33 is connected to the respective longitudinal rod 2, the respective elongated rod 31 and the respective short rod 32. Each of the couplers 34 is connected to two elongated rods 31 or two short rods 32.

Each of the link devices 121 has two block plates 120, and a U-shaped plate 122 connected to the respective inner pipe 1322.

Each of the couplers 34 has a U-shaped main body 341, a mount 343 engaging with the U-shaped main body 341, and a compression spring 342 disposed between the mount 343 and the U-shaped main body 341. The mount 343 has a lower positioning plate 3431, two recesses 3433, and four slant holes 3432. The U-shaped main body 341 has an upper positioning plate 3411, four oblong holes 3412, and a plurality of protruded balls 3413. Each of the elongated rods 31 has a bottom groove 311. The protruded balls 3413 are inserted in the recesses 3433. The U-shaped main body 341 is inserted in the mount 343. Two fasteners 344 pass through the slant holes 3432 and the oblong holes 3412 to fasten the U-shaped main body 341 and the mount 343 together.

Figure 5:
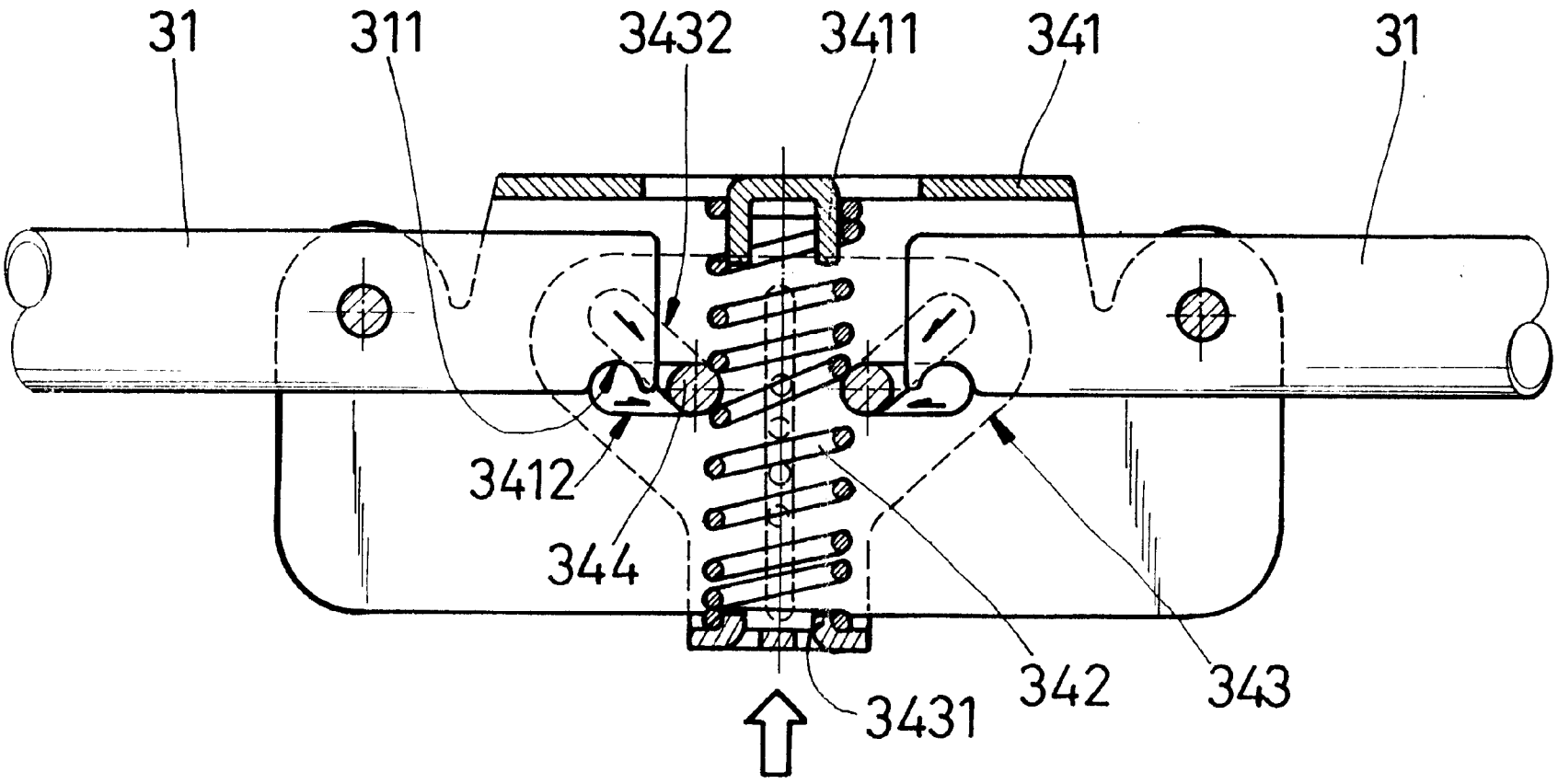
FIG. 5 is a schematic view illustrating an operation of a coupler of a preferred embodiment in accordance with the present invention.
Figure 6:
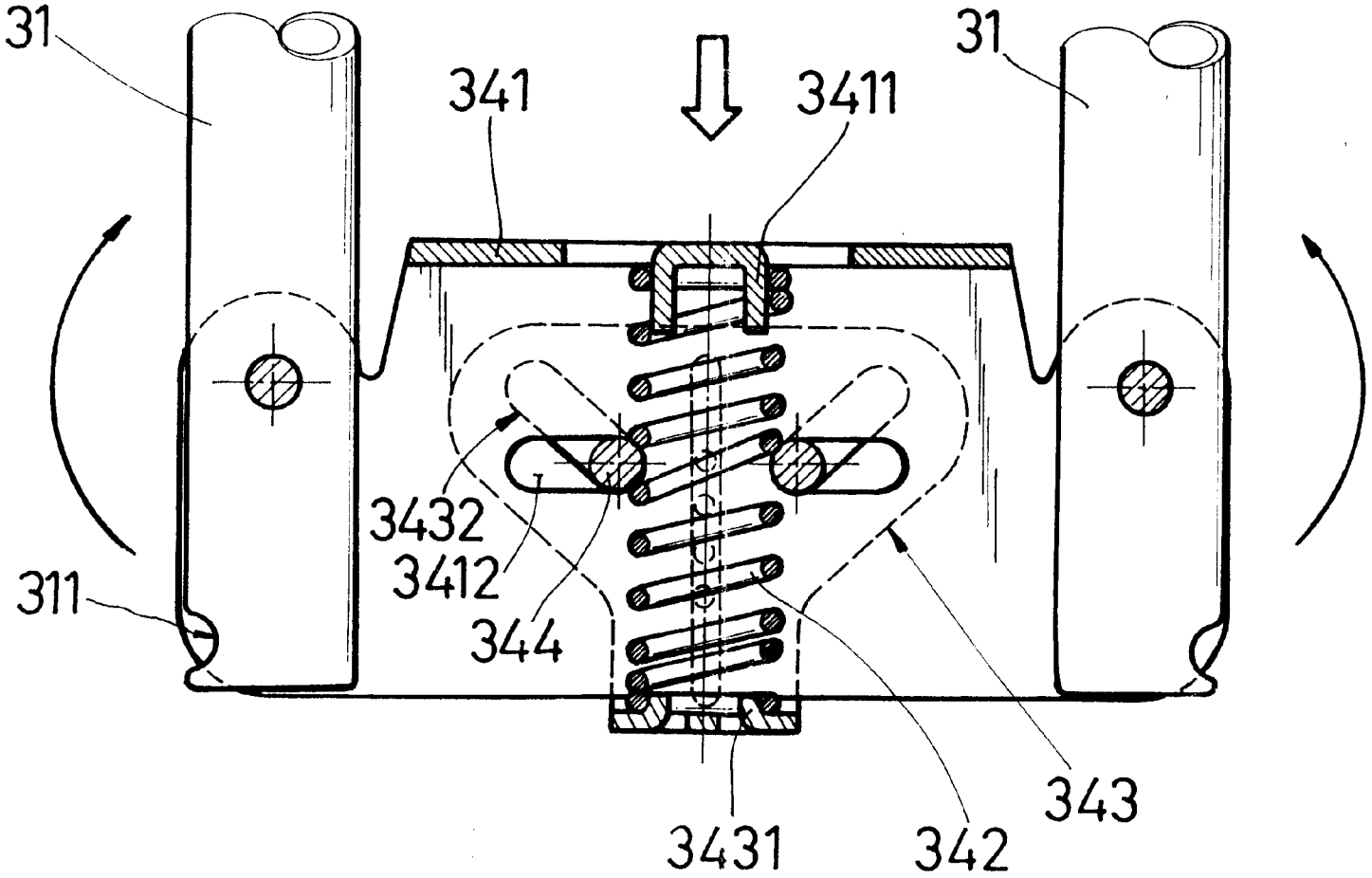
FIG. 6 is another schematic view illustrating an operation of a coupler of a preferred embodiment in accordance with the present invention.
Figure 7:
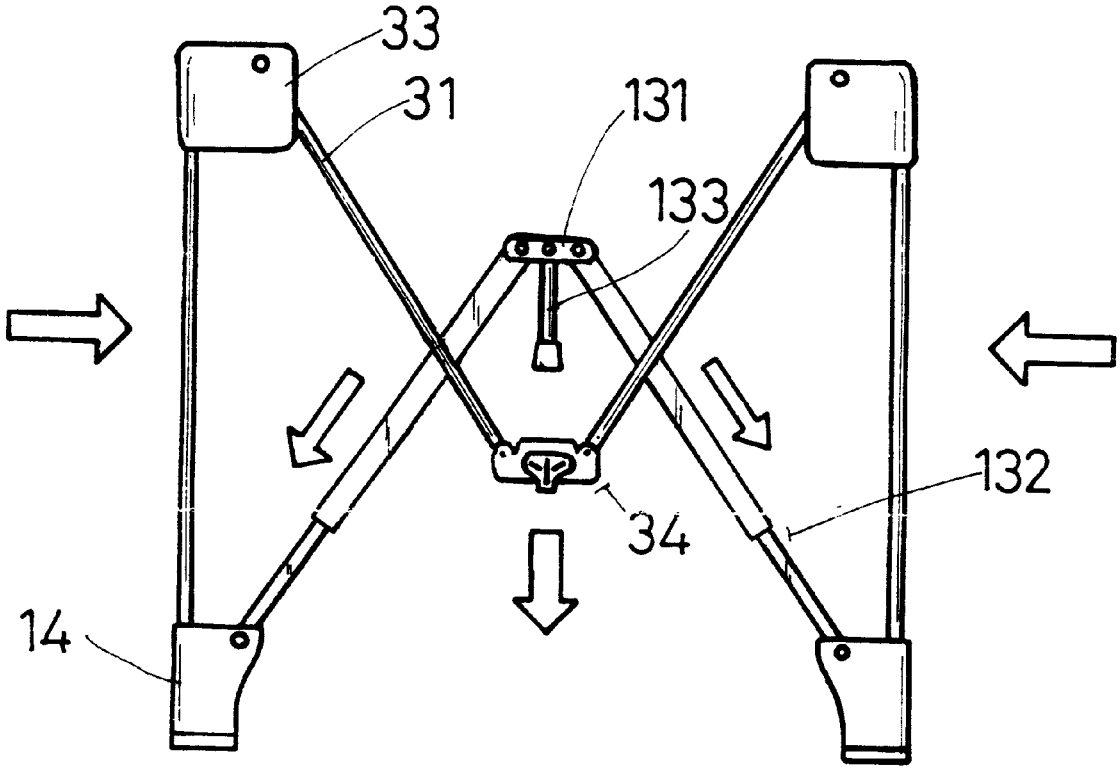
FIG. 7 is a schematic view illustrating a folding of a bed frame assembly of a preferred embodiment in accordance with the present invention.

Referring to FIGS. 5 to 7, the mount 343 is moved upward. The fasteners 344 are moved downward. The elongated rods 31 and the short rods 32 are moved downward. The user can move the link devices 121, the joints 111, and the knuckle 131 upward. Therefore, the bed frame assembly is folded.

The present invention is not limited to the above embodiment but various modification thereof may be made. Furthermore, various changes in form and detail may be made without departing from the scope of the present invention.

I claim:

1. A bed frame assembly comprises:

a lower frame, an upper frame, and four longitudinal rods disposed between the lower frame and the upper frame, the lower frame having four lower corner seats, four elongated bars, four short bars, two link devices, two joints, and a tube device, the tube device having two telescopic tubes and a knuckle connected to the telescopic tubes, each said telescopic tube having an inner pipe and an outer pipe receiving the inner pipe, each said lower corner seat connected to the respective longitudinal rod, the respective elongated bar and the respective short bar, each said link device connected to the respective inner pipe and two short bars, each said joint connected to a support leg and two elongated bars, the knuckle connected to a support post and two outer pipes, the upper frame having four upper corner seats, four couplers, four elongated rods, and four short rods, each said upper corner seat connected to the respective longitudinal rod, the respective elongated rod and the respective short rod, and each said coupler connected to two elongated rods or two short rods.

2. A bed frame assembly as claimed in claim 1, wherein each said link device has two block plates, and a U-shaped plate.

3. A bed frame assembly as claimed in claim 1, wherein each said coupler has a U-shaped main body, a mount engaging with the U-shaped main body, and a compression spring disposed between the mount and the U-shaped main body.

* * * * *